United States Patent [19]

Corcoran

[11] Patent Number: 4,905,558

[45] Date of Patent: Mar. 6, 1990

[54] APPARATUS FOR CUTTING SLITS IN FLEXIBLE PLASTICS SHEETING

[76] Inventor: Sean Corcoran, 34, Clarinda Park West, Dun Laoghaire, County Dublin, Ireland

[21] Appl. No.: 625,977

[22] Filed: Jun. 29, 1984

Related U.S. Application Data

[60] Division of Ser. No. 206,658, Nov. 13, 1980, Pat. No. 4,457,199, which is a continuation-in-part of Ser. No. 685,888, May 12, 1976, abandoned, which is a continuation of Ser. No. 479,133, Jun. 13, 1974, abandoned.

[51] Int. Cl.[4] ..... B26D 3/08

[52] U.S. Cl. ..... 83/862; 83/425.2; 83/852; 83/881; 83/883

[58] Field of Search ..... 83/880, 881, 883, 884, 83/886, 879, 487, 455, 614, 425.2, 425.3, 582, 862–864

[56] References Cited

U.S. PATENT DOCUMENTS

| | | | |
|---|---|---|---|
| 289,162 | 11/1883 | Strachan et al. | 83/883 |
| 3,236,129 | 2/1966 | Bishop | 83/879 |
| 3,292,513 | 12/1966 | Palmer | 83/881 X |
| 3,379,814 | 4/1968 | Bracey Jr. | 83/881 X |
| 3,459,078 | 8/1969 | Black | 83/881 |
| 3,762,250 | 10/1973 | Huskey | 83/425.2 X |
| 3,871,253 | 3/1975 | Pryce et al. | 83/881 |
| 4,094,217 | 6/1978 | Exline | 83/582 X |

FOREIGN PATENT DOCUMENTS

| | | | |
|---|---|---|---|
| 935325 | 8/1963 | United Kingdom | 83/881 |

*Primary Examiner*—Frank T. Yost
*Assistant Examiner*—Rinaldi Rada
*Attorney, Agent, or Firm*—Stevens, Davis, Miller & Mosher

[57] ABSTRACT

The invention relates to apparatus for cutting a series of spaced-apart continuous linear slits in a sheet of flexible plastics material, for example in the manufacture of an ajustable width blind. In one embodiment the apparatus includes a feed roller for feeding sheeting to be slit to a support means, a plurality of slitting blades movable in a direction transverse to the direction of travel of the sheeting and means for controlling the blades so that they cut to a depth less than the thickness of the material. In a second embodiment the blades are stationary and are adapted to cut in the direction of travel of the material. The blades may be mounted on leaf springs biased towards the material to be cut, means being provided for controlling the biasing force. Alternatively, a stop may be provided to control the depth of cut of the blades.

4 Claims, 4 Drawing Sheets

APPARATUS FOR CUTTING SLITS IN FLEXIBLE PLASTICS SHEETING

This is a Division of application Ser. No. 206,658 filed Nov. 13, 1980 now U.S. Pat. No. 4,457,199 patented July 3, 1984, which in turn is a Continuation-in-Part of application Ser. No. 685,888, filed May 12, 1976, now abandoned, which in turn is a continuation of Ser. No. 479,133 of June 13, 1974, now abandoned.

The present invention relates to a method and apparatus for cutting slits in flexible plastics sheeting.

My. U.K. Pat. No. 1 420 329 concerns sheeting of flexible plastics material formed with a series of spaced-apart linear slits in one surface of the material which form lines of uniformly reduced thickness parallel to one edge of the sheeting and which are almost invisible to the human eye, strips of the material being removable from the sheeting by tearing manually along the slits; and includes window blind material made from such sheeting. My aforesaid patent specification also discloses the manufacture of a roller blind by taking a sheet of the material prepared in accordance with the invention, reducing the width of the sheet to the desired width of the blind by removing a strip or strips of material from a side edge of the sheet, and then attaching the sheet to a roller. In my U.S. patent application Ser. No. 685,888 (see U.S. Pat. No. 4,457,199) there is disclosed an adjustable width window blind comprising a sheet of flexible plastics material which is attached by a top edge portion thereof to a roller, wherein the sheet is formed with a plurality of spaced-apart linear slits in one surface of the material which form continuous lines of uniformly reduced thickness which are parallel to a side edge of the sheet and which are substantially normal to the longitudinal axis of the roller, and wherein the slits are cut without causing any permanent substantial deformation of the material and are cut to a depth of less than the total thickness of the material and to permit peeling separation of the sheet along a selected slit without distortion of the resulting separated edges, the arrangement being such that the sheet may be reduced in width while still attached to the roller by manually peeling a strip or strips of the material from a side edge of the sheet.

It is an object of the invention to provide a method and apparatus suitable for cutting the slits in the flexible plastics material.

Accordingly, the invention provides apparatus for use in cutting slits in flexible plastics sheeting, said apparatus comprising a feed roller for the material to be slit, support means for the material, means for feeding the material from the feed roller over the support means, a plurality of pressure-loaded thin cutting blades mounted side by side in spaced-apart parallel arrangement above the support means with a cutting edge of each blade disposed in the general direction of travel of the material to be slit, and means for adjusting the pressure on said blades whereby the depth of cut of the blades may be altered. In an alternative embodiment the blades are mounted on a carriage reciprocally movable transversely of the direction of travel of the material and the cutting edge of each blade is disposed normal to the general direction of travel of the material, whereby the slits are cut in the material in a direction transverse of the direction of travel of the material through the apparatus. In order that the slits may be substantially invisible to the naked eye, the cutting edge of the blades is preferably of a thickness not greater than 0.025 mm and suitably is in the range 1/1200 mm and 0.025 mm. In a preferred embodiment stop means are provided adjacent each blade to control the depth of cut of the blade.

The invention is further illustrated with reference to the accompanying drawings, wherein.

Figure 1:
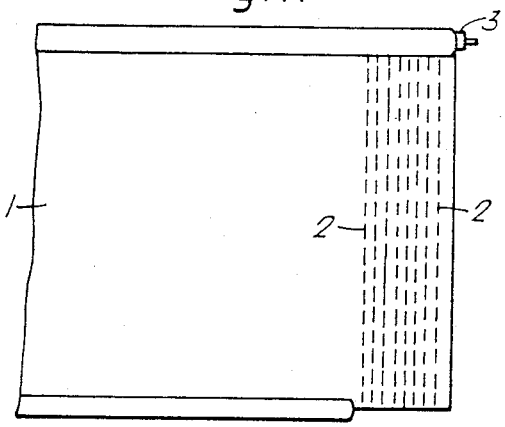
FIG. 1 is a front elevation of flexible sheeting prepared by the method and apparatus of the invention for use in the manufacture of a roller blind.
Figure 2:
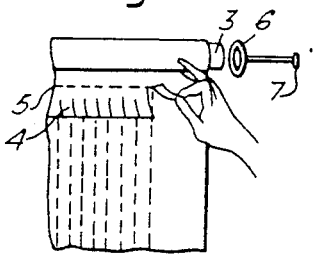
FIG. 2 shows a detail of FIG. 1.
Figure 7:
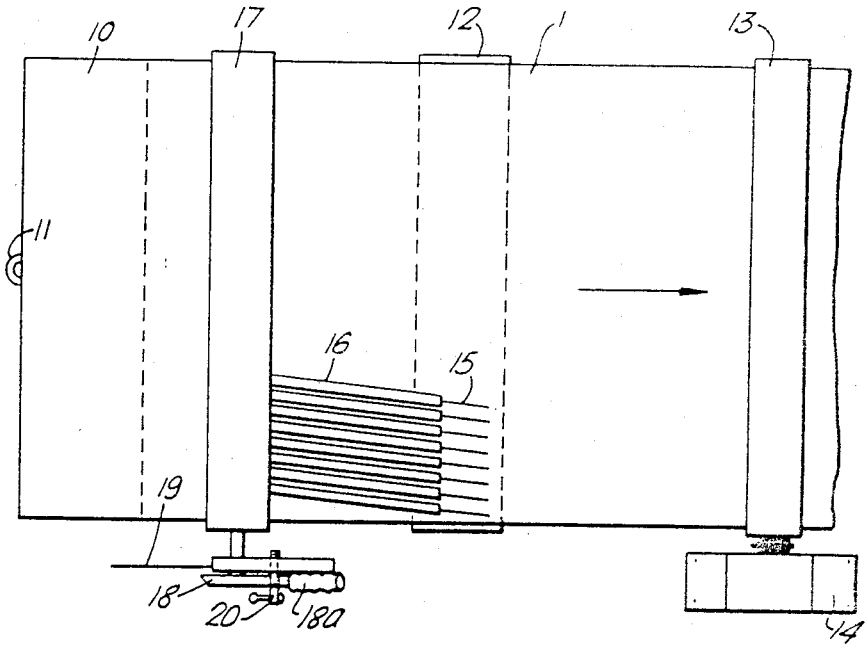
FIG. 7 is a plan view of the apparatus shown in FIG. 6.

Referring to FIGS. 1 and 2 of the drawings, these show a sheet of flexible material for use in the manufacture of a roller blind. The sheet 1 is of a plastics material preferably PVC. The sheet is formed with a series of linear slits 2 cut in one surface. The sheet may have a thickness of 8 thousandths of an inch and the slits are preferably of a width of about 1/1200 mm so that they are invisible to the naked eye. In this case the slits are cut in the right hand, as viewed in the drawing, lateral portion of the sheet and are arranged parallel to the edge of the sheeting. The lateral portion in which the slits are cut may extend inwardly for about 12 inches. The material is then fitted to a roller 3 as shown in FIG. 7. At the top edge of the material the slits penetrate through the material to form tabs 4, about one-half inch long and which indicate the position of the tear-off strips. The roller is inserted in a pocket formed in the material by a line of stitching 5. Slip between the roller and pocket is prevented in well known manner by staples driven through the material and into the roller. In order to alter the blind to a desired width the appropriate tab is pulled by hand until the stitching is reached. The stitching is snipped and the strip can then be peeled from the sheet without difficulty along the whole length of the blind. A clear cut is left which will not fray. The surplus roller is then cut away and the end plate 6 is fitted to the cut end by a pin 7.

It wil be appreciated that in an alternative embodiment the indicator tabs may be formed in the bottom edge of the sheet, and the portion of the sheet containing the tabs may be removed by providing a transverse tear line parallel to the bottom edge so that the tab-containing portion can be torn off after the width of the blind has been adjusted.

Figure 3:
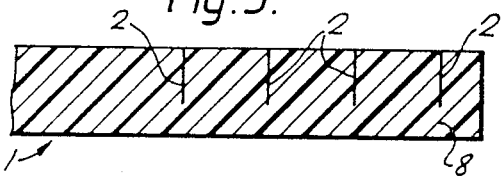
FIG. 3 is a fragmentary sectional view through a portion of the sheeting of FIG. 1 to an enlarged scale.

Referring now to FIG. 3 of the drawings it will be noted that each of the slits 2 penetrate downwardly from top surface of the sheet 1 a substantially equal distance. Thus, an uncut thickness 8 exists between the bottom of each slit and the lower surface of the sheet 1.

Figure 4:
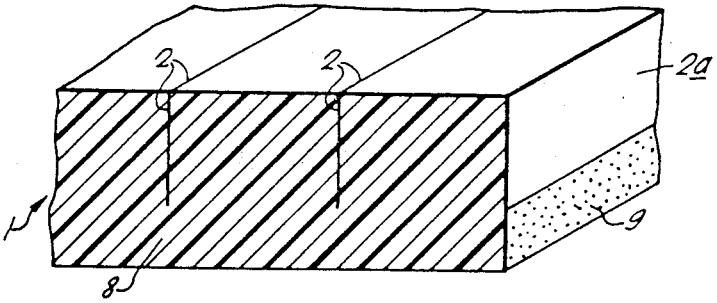
FIG. 4 is a sectional end view of the sheeting of FIG. 3 with a marginal portion removed.

Referring now to FIG. 4 of the drawings the condition of the sheet is illustrated after the sheet has been adjusted to its final size. Thus, in this instance, the portion of the sheet to the right of slit 2a has been determined to be excess material, and the user, after grasping the sheet on either side of slit 2a, has peeled the sheet along slit 2a, thereby severing the portion of the sheet member to the right of slit 2a. The severed area is illustrated, in a greatly exaggerated form for purposes of illustration, at 9. Since the thickness of the sheet member is only a few thousandths of an inch, it will be appreciated that the severed area 9 is, for all practical purposes, not detectable by the human eye.

In the embodiment of FIGS. 3 and 4, a sheet 1 was illustrated in which the upper and lower surfaces lay in flat, parallel planes.

Figure 5:
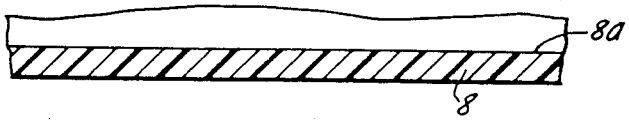
FIG. 5 is a sectional side elevation of a second embodiment of sheeting of the invention to an enlarged scale.

In FIG. 5 an alternative embodiment is illustrated in which the upper and lower surfaces do not lie in parallel planes. The upper surface for example is representative of the surface configuration of an embossed sheet material and FIG. 4 thus accordingly represents a sheet material which has been embossed on the top side. In this instance the bottom of a cut is represented by line 8a.

The thickness of uncut material 8, and likewise, the thickness between the bottom 8a of the slit in FIG. 4, and the bottom surface of the sheet should be of a depth sufficient to resist stresses to which the material is subjected to during manufacture, transportation and handling prior to final installation of the blind, and yet sufficiently thin so that the sheet can be peeled by human hand pressure applied to one end of the sheet in a direction to separate the sheet along a slit 1.

For example, where the sheet is comprised of polyvinyl chloride the nominal thickness of the sheet may be 8/1000th of an inch, and the depth of thickness of uncut portion 27 may be about 6/1000th of an inch.

It is important that the sheet member be formed of a flexible material which has the characteristics, with respect to strength, formability and shape retention, of plastics material. Of particular importance is the ability of the material to have a memory or, as is more commonly known, a plastics memory whereby the material, once compressed or temporarily displaced, as by cutting, tends to return to its original shape. As a consequence, after a cut is made in the sheet material, and particularly a cut which does not remove any significant amount of material, the sides of the cut, after a period of time move together into close, abutting contact so that no space appears in a cross-sectional view as illustrated in FIGS. 3 and 4 for example. As a consequence, and assuming the cut is made by a tool having a cutting edge of rather fine dimensions, as for example in the range of about 1/1200th of a millimetre to 0.025, the cuts become invisible to the naked eye, at least when viewed from a vantage point of a few inches away from the material. Since the final window shade will, invariably, be located and viewed from a number of feet the shade presents, in effect, a uniform, uninterrupted surface to the eye of the observer.

Figure 6:
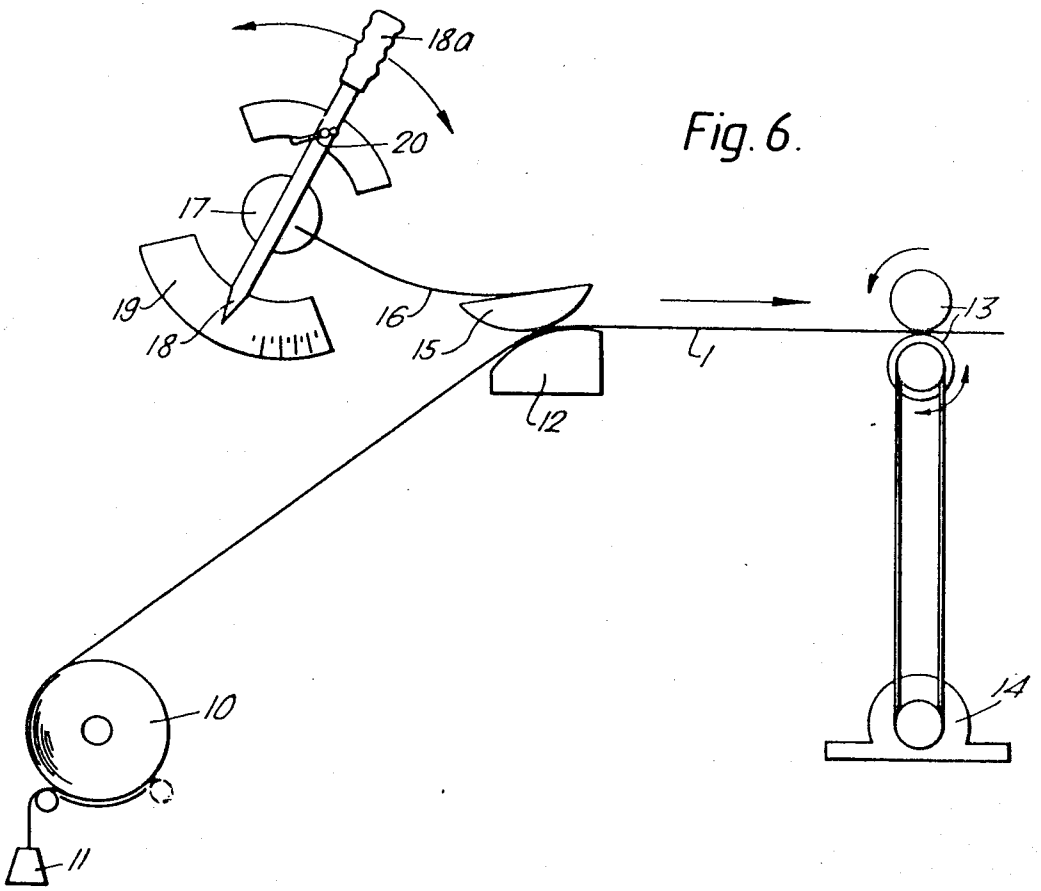
FIG. 6 is a diagrammatic front elevation of one embodiment of apparatus of the invention.

Referring now to FIGS. 6 and 7 of the drawings, one embodiment of apparatus for cutting a series of spaced-apart linear slits in a sheet of flexible plastics material comprises a feed roller 10 on which matreial 1 to be slit may be wound. Such material is generally supplied in rolls. A brake 11 is provided for retarding rotation of the roller 10 and to keep the sheeting under tension. The material 1 is fed from the roller 10 over a slitting support or saddle 12, by means of drive rollers 13, driven by an electric motor 14. An array of slitting blades 15 is mounted above the support 12. The slitting blades 5 may be in the form of surgical type blades or disc blades and are ground to a very sharp cutting edge which, preferably, is of a thickness of about 1/1200 mm and not greater than 0.025 mm. Each blade is individually mounted on the end of a leaf spring 16. Each leaf spring 16 is connected at its other end to a rotatable shaft 17. An indicator 18 is fixed to the end of the shaft and has a handle 18a for rotating the shaft. The indicator 18 is associated with a scale 19. Rotating of the shaft will alter the pressure or tension in the springs 16 and so alter the depth of cut of the blades 15. The indicator and shaft may be clamped in a desired position by means of a clamp 20.

Means may be provided for moving the shaft 17 forwards and rearwards in a horizontal plane so as to bring different parts of the blade into contact with the sheeting as the blade edges wear.

It will be appreciated that with this machine the slits are cut longitudinally and so the cutting edges of the blades are disposed in the direction of travel of the material. In the embodiment shown eight blades are provided but this number may be increased as desired.

Figure 8:
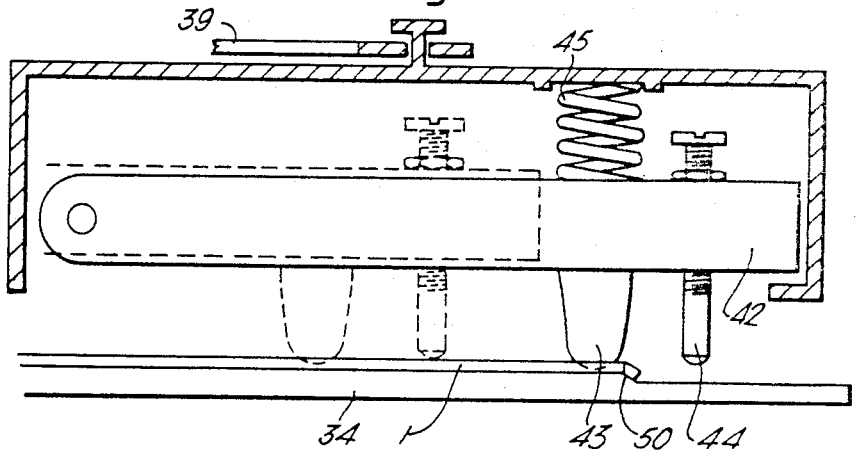
FIG. 8 is a section end elevation of a detail of a second embodiment of apparatus of the invention.
Figure 9:
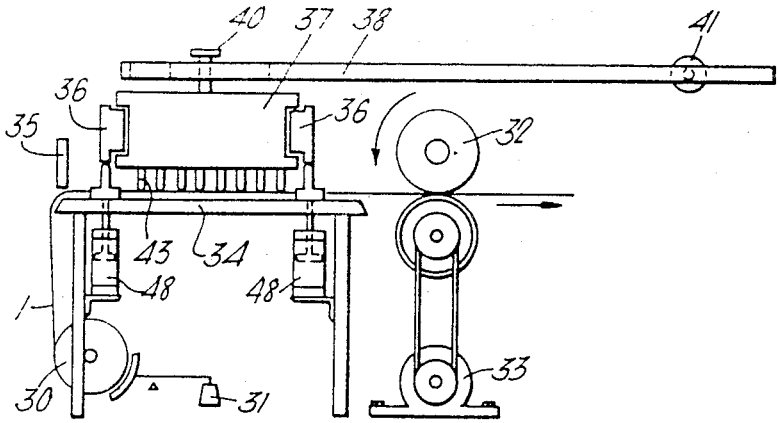
FIG. 9 is a front elevation of the second embodiment of apparatus of the invention.
Figure 10:
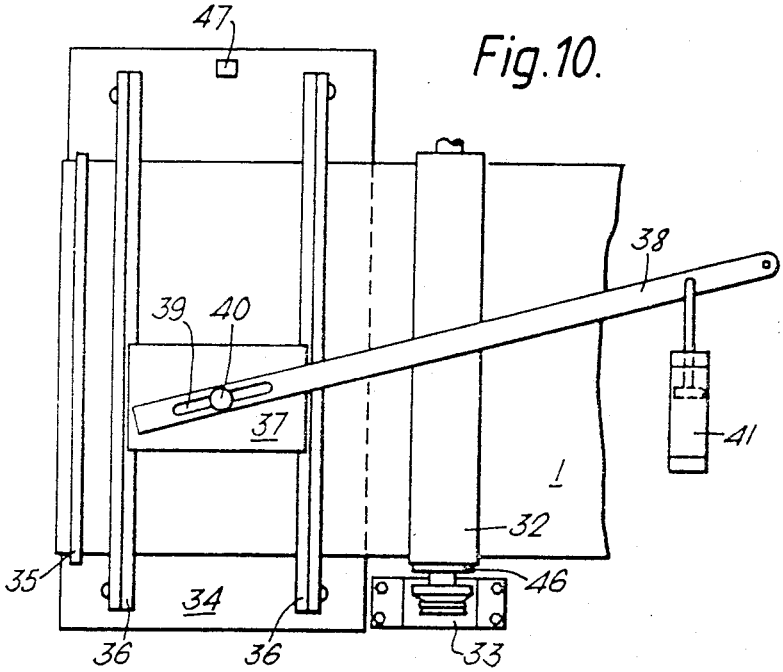
FIG. 10 is a plan view of the apparatus of FIG. 9.

Referring now to the embodiment shown in FIGS. 8 to 10, the apparatus comprises a feed roller 30 having a retarding brake 31. The material 1 to be slit is fed from the roller 30 by means of drive rollers 32 driven by an electric motor 33. The material is fed over a support in the form of a table 34. The material first passes beneath a clamping guide 35, and then below a pair of spaced-apart parallel rails 36 which are mounted transversely of the table 34. If desired the material may be held in place on the table during slitting by means of a vacuum box. A blade carriage 37 is reciprocally movable on the rails by means of a shaft 38. The shaft 38 has a longitudinal slot 39 which engages with a stud 40 on the cariage. The shaft 38 is driven by a pneumatically operated piston and cylinder arrangement 41.

The blade carriage 37 is shown in more detail in FIG. 8. Mounted within the carriage are a plurality of blade support arms 42. Each support arm is pivotally connected at one end to the carriage and carries a slitting blade 43 at the other end. The blade 43 is of the surgical type or is a disc blade. The blades are ground to a very sharp cutting edge which preferably has a thickness in the order of 1/1200 mm. The depth of the cut of each blade is determined by an adjustable stop 44 which is mounted on the support arm 42 adjacent the blade. The stop member is so shaped as to provide a temporary flattening of any corrugations in the material, during its slitting operation, and so ensures that a substantially constant depth of uncut material remains. Each support arm 42, blade 43 and stop 44 is biased downwardly towards the surface of the table 34 by compression springs 45 disposed between the arms 42 and the carriage.

It will be appreciated that in this embodiment the cutting edges of the blades are disposed transversely of the direction of travel of the material and the blades cut in this direction. The reason for this is that PVC sheeting is not usually available in rolls of a width exceeding 72 inches and frequently roller blinds of a width exceeding 72 inches are required. Thus, in this arrangement a measuring roller is associated with the drive rollers 32. When a predetermined length of material, say 8 feet, is fed from the feed roller 30, the measuring roller will activate switch means (not shown) which will act to disengage the drive rollers 32 from the motor 33 by means of a clutch 46 to halt movement of the material.

Simunltaneously the brake 31 and clamp 35 are applied, and the carriage 37 is set in motion and will traverse the stationary material. As the carriage traverses the blades are forced by the springs 45 to cut the required slits. At the end of the traverse the carriage srikes limit switches 47 which actuate pneumatic cylinder and piston arrangement 48 to raise the rails upwards from the table 34. In this way the blades 43 are raised upwards out of contact with the material 1 on the return run of the carriage 37. The limit switches 47 also cause the clutch 46 to engage and a further length of material is fed beneath the blades for slitting.

As mentioned previously, in order to locate the slits it is desirable for the first inch or so of the slits to be cut right through to form a series of tabs. This is achieved by providing a ramp 50 at the side of the table over which a lateral edge of the material passes. As shown in FIG. 8 the blades, during the cutting stroke, effectively trail beneath the carriage and as they pass over the ramp they cut through the material because at that stage they are not subject to the control of the stops 44 which are positioned behind the blades.

Instead of the pneumatic piston and cylinder arrangement 48 which lifts the blades on the return journey of the carriage 37, the support arms 42 can be caused to rise by a series of cams or the like.

If desired, the arrangment may be such that the sheeting is slit both in the transverse and longitudinal directions so as to give criss-cross slitting effect.

Instead of mounting blade carriage 37 on rails 36 the carriage may be mounted on driven wheels which urge the carriage across the sheeting. The wheels are in contact with the sheeting and so tend to move the sheeting in a direction which is opposite to the direction of travel of the blades thus counteracting the tendency of the blades to drag the sheeting. The wheels may be kept in contact with the sheeting be pressure from an overhead rail.

The outermost blade of the blade array may be arranged to cut right through the sheeting so as to sever each window blind length from the roll of material after slitting has taken place. The several lengths may be removed from the slitting area by means of rollers or a conveyor belt. Preferably, means are provided for positioning a window blind roller adjacent said conveyor means such that the top edge of the sheet will come into contact with the roller. Either the roller or the top edge of the sheet, or both, is provided with a strip of adhesive such that the top edge of the sheet will adhere to the roller (apart from that portion containing the slits). The roller is then rotated either by external means or by means of its own internal rewind mechanism so as to wind the material onto the roller to provide a complete roller blind.

In the embodiment shown in FIGS. 6 and 7 of the drawings the depth of cut of the blades is achieved by means of the leaf springs 16 and rotatable shaft 17. It will be appreciated that such an arrangement may also be utilized with the transverse cutting apparatus of FIGS. 8 to 10 instead of the adjustable stop 44. Likewise an adjustable stop may be used with the longitudinal cutting apparatus of FIGS. 6 and 7 for adjusting the depth of cut of the blades of the spring shaft arrangement.

I claim:

1. Apparatus for cutting a series of spaced-apart continuous linear slits in a sheet of flexible plastics material comprising a feed roller for the material to be slit, support means for the material, means for feeding the material from the feed roller over the support means, an array of slitting blades mounted side by side in spaced-apart parallel arrangement above the support means, a cutting edge on each of said blades disposed in the general direction of travel of the material to be slit, support means for said array of slitting blades, and means for controlling said blades so as to cut to a depth less than the thickness of the plastics material, said means for controlling the depth of cut of the blades comprises a rotatable shaft, a plurality of resilient connecting means connected to and extending radially or tangentially from the shaft, each resilient connecting means carrying one of said blades, and adjusting means for rotating the shaft to alter the pressure on said resilient connecting means whereby the depth of cut of the blades may be adjusted.

2. The apparatus of claim 1 in which the resilient connecting means is a plurality of leaf springs.

3. Apparatus for cutting a series of spaced-apart continuous linear slits in a sheet of flexible plastics material comprising a feed roller for the material to be slit, support means for the material, means for feeding the mateial from the feed roller over the support means, an array of slitting blades mounted side by side in spaced-apart parallel arrangement above the support means, a cutting edge on each of said blades disposed in the general direction of travel of the material to be slit, support means for said array of slitting blades, and means for controlling said blades so as to cut to a depth less than the thickness of the plastics material said controlling means comprising a stop for controlling the depth of cut of the blades.

4. Apparatus as claimed in claim 3 wherein there is a stop associated with each blade for controlling the depth of cut of that blade.

* * * * *